US006886528B2

(12) United States Patent
James

(10) Patent No.: US 6,886,528 B2
(45) Date of Patent: May 3, 2005

(54) ROTARY MACHINE

(76) Inventor: Richard G. James, 403 Creek Bottom Ct., Canton, GA (US) 30115

( * ) Notice: Subject to any disclaimer, the term of this patent is extended or adjusted under 35 U.S.C. 154(b) by 0 days.

(21) Appl. No.: 10/414,865

(22) Filed: Apr. 16, 2003

(65) Prior Publication Data

US 2003/0192503 A1 Oct. 16, 2003

Related U.S. Application Data

(60) Provisional application No. 60/372,949, filed on Apr. 16, 2002.

(51) Int. Cl.[7] ..... F02B 53/00; F01C 19/02

(52) U.S. Cl. ..... 123/246; 418/115; 418/204

(58) Field of Search ..... 123/241, 246, 123/249; 418/204, 115, 206.6, 206.5, 206.4

(56) References Cited

U.S. PATENT DOCUMENTS

| | | | | | |
|---|---|---|---|---|---|
| 1,834,976 | A | * | 12/1931 | Schmidt | 418/204 |
| 2,845,909 | A | * | 8/1958 | Pitkanen | 123/246 |
| 3,329,067 | A | | 7/1967 | Rosaen | |
| 3,721,510 | A | * | 3/1973 | Gilbert | 418/115 |
| 3,929,402 | A | | 12/1975 | Schubert | |
| 4,640,242 | A | * | 2/1987 | Meyman | 123/246 |
| 4,677,950 | A | * | 7/1987 | Buske | 123/241 |
| 5,681,157 | A | | 10/1997 | Wen-Ming | |
| 5,704,332 | A | | 1/1998 | Motakef | |
| 5,758,617 | A | | 6/1998 | Saito | |
| 5,788,472 | A | | 8/1998 | Lee | |
| 5,803,041 | A | | 9/1998 | Motakef | |
| 5,820,349 | A | | 10/1998 | Caillat | |
| 5,845,617 | A | | 12/1998 | Sager | |
| 5,901,568 | A | | 5/1999 | Haga | |
| 5,937,661 | A | | 8/1999 | Kishimoto et al. | |
| 5,950,522 | A | | 9/1999 | Balfour | |
| 6,039,549 | A | | 3/2000 | Tarng et al. | |
| 6,070,565 | A | | 6/2000 | Miniere | |
| 6,106,242 | A | | 8/2000 | Sung | |
| 6,132,190 | A | | 10/2000 | Tverskoy | |
| 6,168,385 | B1 | | 1/2001 | Clamp | |
| 6,223,703 | B1 | | 5/2001 | Galvin | |
| 6,250,278 | B1 | | 6/2001 | Mekler | 123/241 |
| 6,250,280 | B1 | | 6/2001 | Miller | |
| 6,253,717 | B1 | | 7/2001 | Doyle | |
| 6,276,329 | B1 | | 8/2001 | Archer | |
| 6,279,518 | B1 | | 8/2001 | Cooley | |
| 6,283,728 | B1 | | 9/2001 | Tomoiu | |
| 6,290,472 | B2 | | 9/2001 | Gannaway | |
| 6,298,821 | B1 | | 10/2001 | Bolonkin | |

(Continued)

FOREIGN PATENT DOCUMENTS

| | | | | | |
|---|---|---|---|---|---|
| AT | 378241 | | | 11/1984 | |
| DE | 589714 | A | * | 12/1933 | F02B/53/00 |
| DE | 633456 | A | * | 7/1936 | F02B/53/00 |
| DE | 2412888 | A1 | | 3/1974 | F01C/1/24 |
| DE | 3042783 | A1 | | 11/1980 | F01C/1/18 |
| DE | 19616880 | A1 | | 4/1996 | F04C/18/28 |
| EP | 638722 | A1 | * | 2/1995 | F04C/18/12 |
| FR | 8108309 | | | 10/1982 | |
| FR | 2690201 | A1 | * | 10/1993 | 418/204 |
| JP | 63-21381 | | | 7/1986 | |
| JP | 63-21382 | | | 7/1986 | |
| JP | 63021381 | | | 1/1988 | F04C/18/28 |
| JP | 63021382 | | | 1/1988 | F04C/18/28 |
| WO | WO 84/00993 | | | 3/1984 | 123/246 |

*Primary Examiner*—Thai-Ba Trieu
(74) *Attorney, Agent, or Firm*—Gardner Groff, P.C.

(57) ABSTRACT

At least two rotors are mounted in a chamber and rotate synchronously to compress and/or transport fluid. The chamber has the shape of partially overlapping circles with each circle intersecting the center of the adjacent circle. The rotors are non-eccentric and have curved sides with the same radius as the circles. In exemplary embodiments, the rotors are trochoidal and the chamber is epitrochoidal. Also provided are compressors, pumps, actuators, and engines incorporating the rotary machine.

34 Claims, 13 Drawing Sheets

U.S. PATENT DOCUMENTS 6,301,898 B1 10/2001 Choroszylow et al.
6,305,345 B1 10/2001 Bakhtine
6,325,603 B1 12/2001 Moller
6,336,794 B1 1/2002 Kim
6,336,800 B1 1/2002 Kim
6,378,470 B1 4/2002 Keever
6,392,321 B1 5/2002 Dung-Lung
6,394,776 B2 5/2002 Boldenow
6,405,703 B1 6/2002 Sowards
6,412,454 B1 7/2002 Green
6,428,284 B1 8/2002 Vaisman
6,447,268 B1 9/2002 Abramopaulos
6,484,687 B1 11/2002 Duncan
6,499,301 B1 12/2002 Choroszylow
6,520,754 B2 2/2003 Randolphi
6,536,383 B2 3/2003 Santiyanont
2002/0157636 A1 10/2002 Klassen
2002/0179036 A1 12/2002 Duncan
2003/0000496 A1 1/2003 Moe
2003/0000783 A1 1/2003 Kanai et al.
2003/0010312 A1 1/2003 Garcia
2003/0037636 A1 2/2003 Kawata et al.

* cited by examiner

ROTARY MACHINE

CROSS-REFERENCE TO RELATED APPLICATION

This application claims the priority benefit of U.S. Provisional Patent Application Ser. No. 60/372,949, filed Apr. 16, 2002, the entire scope and content of which is hereby incorporated herein by reference.

TECHNICAL FIELD

The present invention relates generally to devices for compressing and/or transporting fluids, and, in particular, to a rotary device for use in machines such as compressors, positive pressure and vacuum pumps, rotary actuators, and combustion engines.

BACKGROUND OF THE INVENTION

Many mechanical devices have compression stages for compressing fluids such as water, air, fuel, etc. to produce work or to transport the fluid. For example, a wide variety of pumps for many different fluids have compression stages. In many conventional pumps, the compression stage is provided by a linearly reciprocating piston-cylinder mechanism. Also, many water and air compressors operate in a similar way. Additionally, conventional internal combustion engines have a compression stage to compress the fuel before igniting it, which provides significantly improved efficiencies. Furthermore, many vacuum or suction devices have intake or suction stages that are provided by linearly reciprocating piston-cylinder mechanisms, with the intake or suction stages during expansion of the interior space instead during compression.

While currently available linear and rotary compression and pumping devices are more efficient than those of years ago, they still are not highly efficient. Accordingly, there is a need for a high performance device that can be used for compressing and/or transporting water, air, fuels, or other fluids in pumps, compressors, vacuum devices, engines, and the like, and that is reliable and cost-effective to build, operate, and maintain. It is primarily to the provision of such a device that the present invention is directed.

SUMMARY OF THE INVENTION

The present invention includes a rotary machine for compressing and/or transporting fluids. Generally described, the rotary machine includes two or more rotors that rotate synchronously in a chamber formed in a housing. The chamber has a side wall with the shape of partially overlapping circles, with each circle intersecting the center of the adjacent circle. The rotors are non-eccentric and have curved sides with the same radius as the circles. These components of the rotary machine can be selected and configured for use with most any type of fluid, including air, water, fuels, lubricants, refrigerants, and other liquids and gases.

When the rotors turn synchronously through a complete 360 degree cycle, they continuously contact or remain in close proximity with each other to provide good rotor-to-rotor sealing. And when the rotors turn through the non-overlapping parts of the circles defining the chamber, they contact or remain in close proximity with the side wall of the housing to provide good rotor-to-housing sealing. In this configuration, a compression sub-chamber is temporarily formed at two 60-degree phases of the rotation by the outer side of the then-leading rotor, the leading side of the then-trailing rotor, and the chamber side wall. In addition, a suction sub-chamber is temporarily formed at two 60-degree phases of the rotation by the trailing side of the then-leading rotor, the outer side of the then-trailing rotor, and the chamber side wall. And at two 60-degree phases of the rotation when the rotors turn through the non-overlapping parts of the chamber circles and do not seal with the chamber side wall, the rotors are in a neutral phase neither compressing nor drawing in the fluid. The two compression phases are offset by 180 degrees, as are the two suction phases and the two neutral phases. Accordingly, the rotors cooperate to complete two compression strokes and two suction strokes during each 360-degree rotary cycle, thereby providing a highly efficient mechanism for compressing and/or transporting fluid.

In a first exemplary embodiment of the present invention, the rotary machine has two trochoidal rotors and the chamber is epitrochoidal. In a second exemplary embodiment, the rotary machine has three rotors mounted in a chamber with the shape of three partially overlapping circles. In a third exemplary embodiment, the rotary machine has two sets of rotors mounted side-by-side and offset by 180 degrees for balance. In a fourth exemplary embodiment, the rotary machine has three sets of rotors arranged side-by-side and offset by 90 degrees for balance. And in a fifth exemplary embodiment, the rotary machine has inlet ports connected together and outlet ports connected together into manifolds.

In a first alternative embodiment the rotors have fluid pressure-operated plunger seals. In a second alternative embodiment the rotors have spring-operated plunger seals. In a third alternative embodiment the rotors have flexible blade seals. In a fourth alternative embodiment the rotors have centrifugal force-operated plunger seals. And in a fifth alternative embodiment the rotors have flange seals for rotor-to-housing sealing.

In addition, the present invention includes compression and/or pumping devices that incorporate one or more of these rotary machines. An exemplary compressor includes a drive device such as an electric motor, a synchronous linkage mechanism such as a belt and pulleys, one or more of the rotary machines, fluid inlet and outlet lines, a one-way inlet check valve, an open/close outlet valve, and a control system. An exemplary positive pressure or vacuum pump includes a drive device such as an electric motor, a synchronous linkage mechanism such as a gear train, one or more of the rotary machines, and fluid inlet and outlet lines. An exemplary rotary actuator includes a synchronous linkage mechanism such as a gear train, one or more of the rotary machines, fluid inlet and outlet lines, and a drive device such as a pump. And an exemplary internal combustion engine includes a synchronous linkage mechanism such as a gear train, one or more of the rotary machines, and fluid inlet and outlet lines with one-way check valves, a fuel/air supply system, an ignition system, and a control system.

Accordingly, the present invention provides an innovative rotary machine that is operable to pump and/or compress fluid. The rotary machine completes one compression stroke and one intake stroke in 180 degrees to provide an efficiency increase over traditional devices. In addition, the rotors are non-eccentric and multiple rotor sets can be offset from each other, which provides a smoother operation. Furthermore, as the rotors turn they cover and uncover the inlet and outlet ports to automatically provide the needed valving for the fluid so that separate timed valving systems are not needed. Furthermore, the rotary machine is simple and reliable to build and maintain relative to conventional compressing and pumping devices.

The specific techniques and structures employed by the invention to improve over the drawbacks of the prior devices and accomplish the advantages described herein will become apparent from the following detailed description of the exemplary embodiments of the invention and the appended drawings and claims.

DETAILED DESCRIPTION OF THE EXEMPLARY EMBODIMENTS

Figure 1:
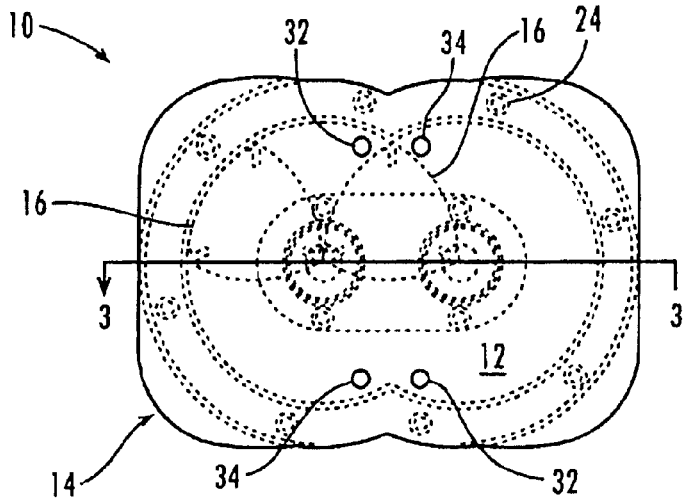
FIG. 1 is a front view of a rotary device according to a first exemplary embodiment of the present invention, showing two rotors mounted in a chamber formed in a housing.
Figure 2:
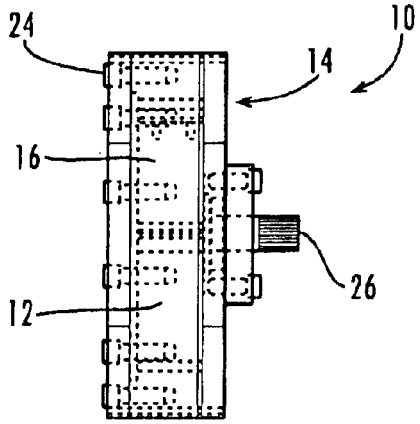
FIG. 2 is a right side view of the rotary device of FIG. 1.
Figure 3:
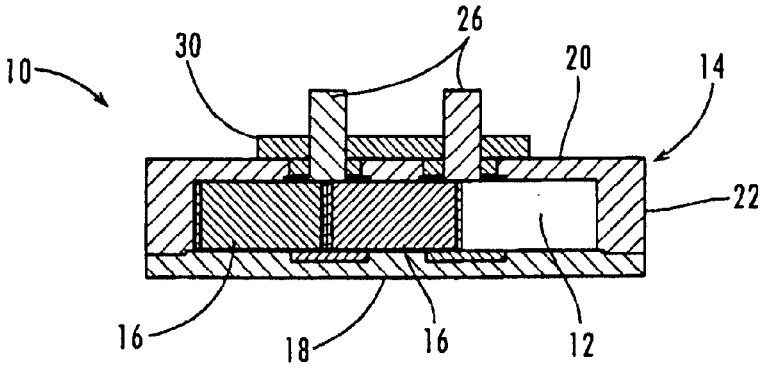
FIG. 3 is a cross sectional view of the rotary device taken at line 3—3 of FIG. 1.
Figure 4:
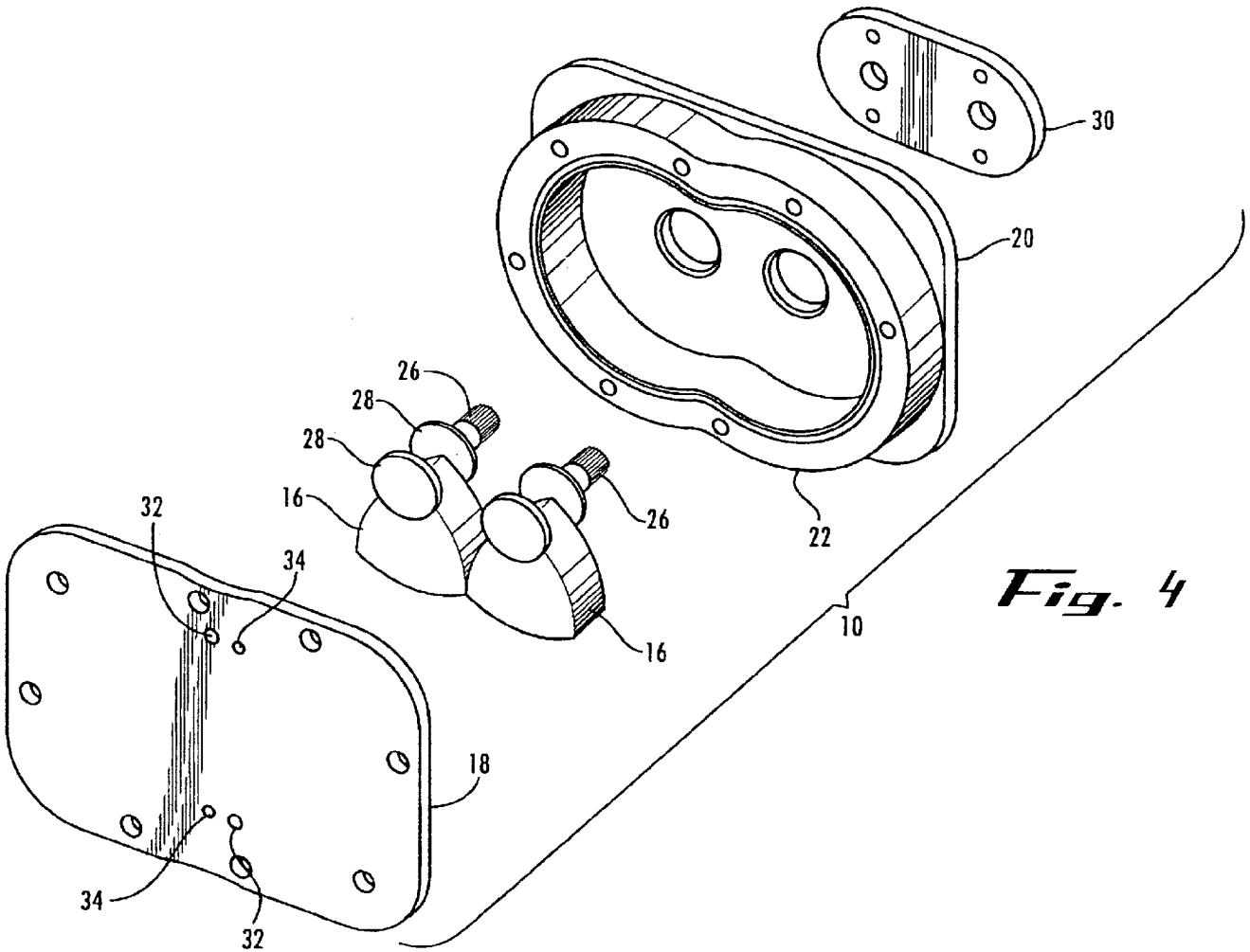
FIG. 4 is an exploded perspective view of the rotary device of FIG. 1.

Referring to the drawings, FIGS. 1–4 illustrate a first exemplary embodiment according to the present invention, referred to generally as the rotary machine 10. The rotary machine 10 operates to compress and/or transport a fluid such as air, water, an air/fuel mixture, a fuel, a lubricant, a refrigerant, hydraulic fluid, a combination thereof, or other liquids or gases. Accordingly, the rotary machine 10 can be used in compressors, positive pressure and vacuum pumps, rotary actuators, rotary combustion engines, and other devices where compressing and/or transporting a fluid is desired, or where a rotary output motion is desired. As such, the rotary machine 10 can be mounted to or integrally formed with other mechanical and electrical components to provide portability, stability, and/or other desired features.

The rotary machine 10 includes a chamber 12 formed in a housing 14 and a plurality of rotors 16 in the chamber 12. The housing 14 has a front wall 18, a rear wall 20, and a side wall 22. If desired, the side wall 20 can be integral with the rear wall 20 (as shown) or the front wall 18. The housing 14 is assembled together using conventional fasteners 24 such as bolts or screws and seals such as gaskets, if desired. In a typical commercial embodiment, the housing 14 is about 11 inches long, about 8 inches high, and about 2 inches wide.

The housing 14 and rotors 16 are made of metal, plastic, acrylic, a composite, or another material selected for strength and durability when subjected to the operating pressures and temperatures of the particular application. For example, in a typical commercial embodiment of the rotary machine 10 used in a conventional water or air pump, the rotors 16 are made of DELRON or another nylon-like material. Furthermore, the material for the housing 14 and/or the rotors 16 can be selected for having a low coefficient of friction. And the rotary machine 10 may include a lubricant and/or a lubricating system for reducing friction between the rotors 16 and the housing 14. In addition, the housing 14 is machined, cast, forged, molded, or made by another fabrication technique known in the art.

The rotors 16 are operably connected to axles 26 for inputting or outputting a rotary motion. For example, connecting plates 28 may be connected by screws, bolts, rivets, pins, or other conventional fasteners to the rotors 16, and the connecting plates 28 may in turn be connected by welds, screws, bolts, or other conventional fasteners to the axles 26. Alternatively, the rotors 16 may be connected directly to or integrally formed with the axles 26. And a bearing plate 30 can be connected to the housing 14 for added strength and stability.

The rotors 16 are coupled together for synchronous rotation by a rotary linkage mechanism such as a gear train, a chain and sprockets, a belt and pulleys, or another operative linkage mechanism known in the art. Several exemplary synchronous rotary linkage mechanisms are described in more detail below with respect to devices incorporating the rotary machine.

The rotors 16 cooperate to compress and/or transport the fluid in the chamber 16, as will be described in more detail below. To allow the fluid into and out of the chamber 16 the housing 14 has inlet ports 32 and outlet ports 34. The inlet and outlet ports 32 and 34 may be located in the front wall 18 (as shown), in the rear and side walls 20 and 22, or in a combination of these walls, as desired. If the inlet and outlet ports 32 and 34 are located closely beside each other, they can be angled through the housing 14 so that they are farther apart on the outside of the housing to provide clearance for the connection of fluid lines. In applications where the fluid is compressed by the rotors 16 within the chamber 14, it is desirable, though not necessary, for the inlet port 32 to be larger than the outlet port 34. In addition, the ports 32 and 34 can be valved, if needed, depending on the pressure of the incoming fluid and of the environment where the outgoing fluid is delivered.

Figure 5:
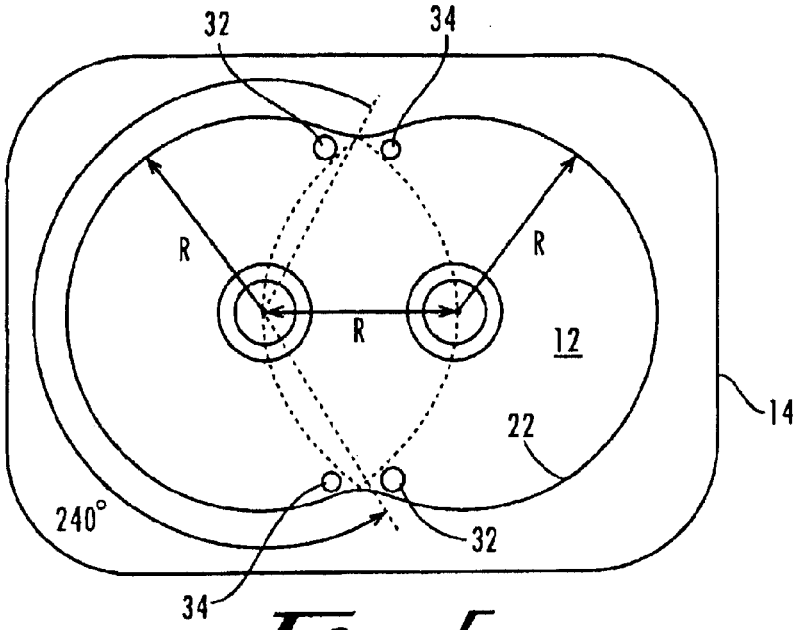
FIG. 5 is a front view of the chamber of the rotary device of FIG. 1, showing the geometry of the chamber.

Referring additionally to FIG. 5, the geometry of the chamber 12 will now be described. The chamber 12 is epitrochoidal, that is, it has the shape of partially overlapping circles. In the first exemplary embodiment, the chamber 12 has the shape of two partially overlapping circles forming a semi-hourglass. The circles each have a radius R, and the centers of the circles are spaced apart by the radius R. In other words, the arc of the overlapping portion of each circle runs through the center of the adjacent circle. As a result, the arc of the non-overlapping portion of each circle defining the chamber 12 has an arc of 240 degrees.

In a typical commercial embodiment, the chamber 12 has a radius R of about 3 inches and a depth of about 1.5 inches. In order to work on a greater volume of fluid, for example, in applications where a higher fluid flow rate is desired or where more power output is desired, these dimensions can be increased. Similarly, in applications where only a relatively small volume of fluid needs to be worked on, these dimensions can be decreased.

Still referring to FIG. 5, for compressor, pump, and actuator applications, the preferred locations of the fluid inlet and outlet ports 32 and 34 are just to one side or the other of the narrow part of the semi-hourglass, in a catercorner arrangement (as shown). In other words, the inlet and outlet ports 32 and 34 are positioned in the non-overlapping portion of each circle, in the corners defined by the side wall 22 and the arc of the overlapping portion of the adjacent circle. In this configuration, the fluid is compressed to the fullest extent possible by the rotors 16 before it is expelled from the chamber 14 through the outlet port 34. And the inlet port 321 is exposed during the suction phase for the maximum amount of time to draw in the largest possible volume of the fluid.

Figure 6:
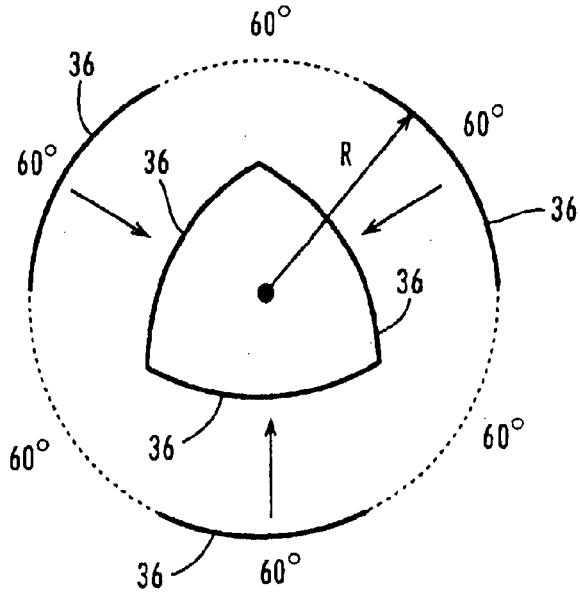
FIG. 6 is a front view of one of the rotors of the rotary device of FIG. 1, showing some of the geometry of the rotors.
Figure 7:
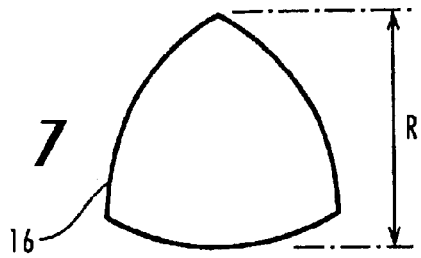
FIG. 7 is a front view of one of the rotors of the rotary device of FIG. 1, showing additional geometry and dimensioning of the rotors.

Referring additionally to FIGS. 6 and 7, the geometry of the rotors 16 will now be described. The rotors 16 are trochoidal, that is, they have the shape of an equilateral triangle with outwardly curved (i.e., swollen) sides 36. Each side 36 of the each rotor 16 has a radius R that is the same as the radius R of the circles defining the chamber 12. Thus, in a typical commercial embodiment, the rotors 16 have a radius R of about 3 inches. And to provide a good seal yet minimize friction and permit fairly free rotation, the rotors 16 have a thickness slightly less than the depth of the chamber 12. Thus, in a typical commercial embodiment, the rotors 16 have a thickness of about 1.5 inches. Because the rotors 16 are equilateral triangles with curved sides 36, each of the sides 36 can be thought of as a 60 degree arc from one of the circles defining the chamber 12 (see FIG. 6). And the rotors 16 each have a height R that is the same as the radius R (see FIG. 7). In the first exemplary embodiment, two of the trochoidal rotors 16 rotate within the chamber 12, though another number and shape of rotors may be used. For example, in alternative embodiments the rotors are circular, pie-shaped, and have other regular or irregular shapes.

Turning now to FIGS. 8–20, the rotors 16 are shown rotating synchronously in the chamber 12 through a complete 360-degree rotary cycle in 30-degree increments. Continuously throughout the entire rotary cycle, close rotor-to-rotor spacing and sealing is maintained. And continuously throughout each 60-degree compression and intake/suction phase, close rotor-to-housing spacing and sealing is maintained. In this configuration, a compression sub-chamber is temporarily formed at two compression phases of the rotation by the outer side of the then-leading rotor 16, the leading side of the then-trailing rotor 16, and the chamber side wall 22. As the fluid is being compressed in the collapsing compression sub-chamber, the rest of the chamber is expanding and drawing in more fluid. In addition, a suction sub-chamber is temporarily formed at two suction phases of the rotation by the trailing side of the then-leading rotor 16, the outer side of the then-trailing rotor 16, and the chamber side wall 22. And at two neutral phases of the rotation when the rotors 16 turn through the non-overlapping parts of the chamber circles and do not seal with the chamber side wall 22, the rotors neither compress nor draw in the fluid.

Figure 8:
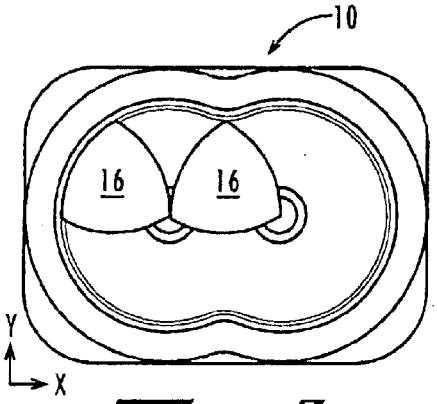
FIG. 8 is a front view of the rotary device of FIG. 1, showing the rotors in a first position of a series of rotor positions that illustrate the rotor-to-rotor sealing through a complete rotary cycle.
Figure 9:
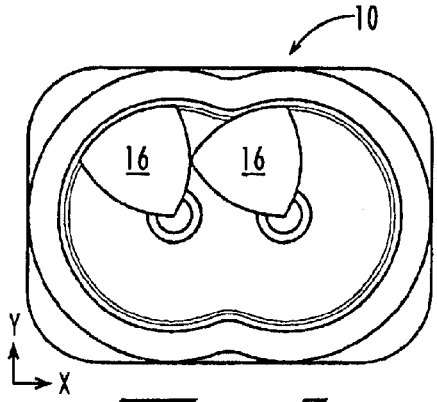
FIG. 9 is a front view of the rotary device of FIG. 8, showing the rotors at 30 degrees from the first position.
Figure 10:
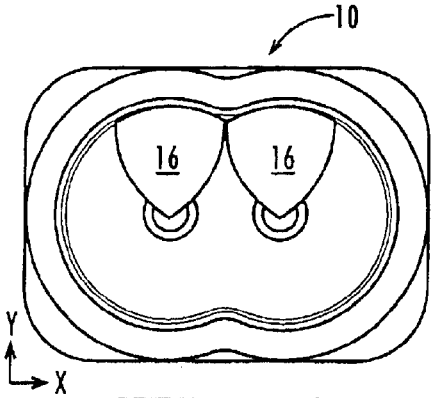
FIG. 10 is a front view of the rotary device of FIG. 8, showing the rotors at 60 degrees from the first position.
Figure 11:
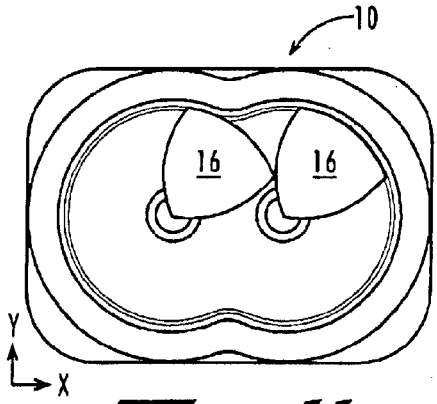
FIG. 11 is a front view of the rotary device of FIG. 8, showing the rotors at 90 degrees from the first position.
Figure 12:
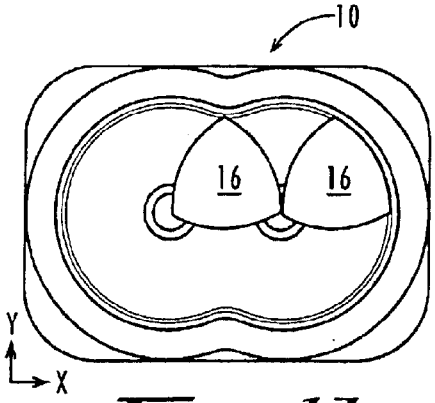
FIG. 12 is a front view of the rotary device of FIG. 8, showing the rotors at 120 degrees from the first position.
Figure 13:
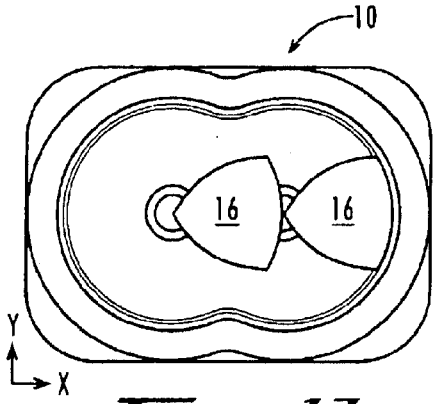
FIG. 13 is a front view of the rotary device of FIG. 8, showing the rotors at 150 degrees from the first position.
Figure 14:
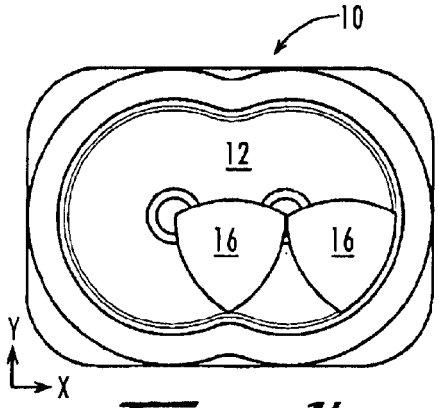
FIG. 14 is a front view of the rotary device of FIG. 8, showing the rotors at 180 degrees from the first position.

FIG. 8 shows the rotors 16 in a first position, FIG. 9 shows them rotated to 30 degrees from the first position, and FIG. 10 shows them rotated to 60 degrees from the first position to complete a 60-degree compression phase. FIG. 11 shows the rotors 16 rotated to 90 degrees from the first position and FIG. 12 shows them rotated to 120 degrees from the first position to complete a 60-degree intake or suction phase. FIG. 13 shows the rotors 16 rotated to 150 degrees from the first position and FIG. 14 shows them rotated to 180 degrees from the first position to complete a 60-degree neutral phase.

Figure 15:
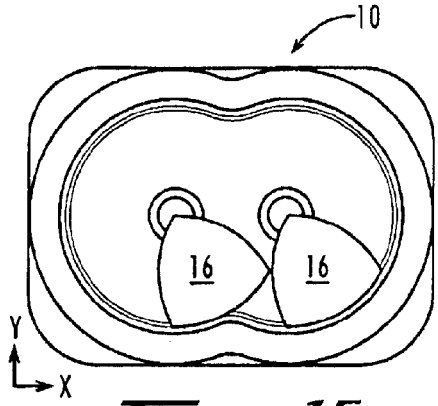
FIG. 15 is a front view of the rotary device of FIG. 8, showing the rotors at 210 degrees from the first position.
Figure 16:
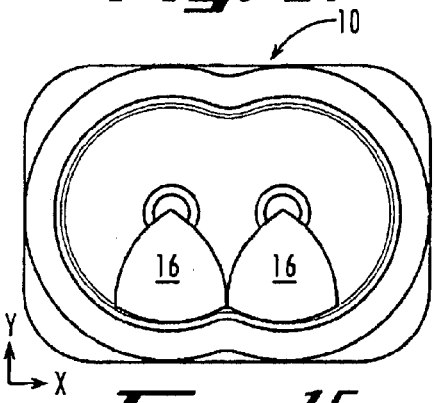
FIG. 16 is a front view of the rotary device of FIG. 8, showing the rotors at 240 degrees from the first position.
Figure 17:
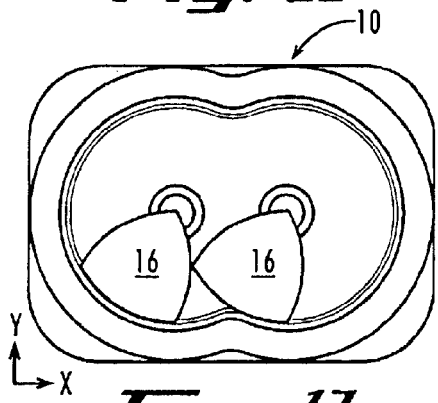
FIG. 17 is a front view of the rotary device of FIG. 8, showing the rotors at 270 degrees from the first position.
Figure 18:
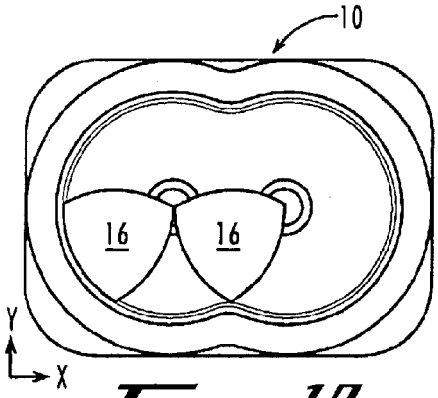
FIG. 18 is a front view of the rotary device of FIG. 8, showing the rotors at 300 degrees from the first position.
Figure 19:
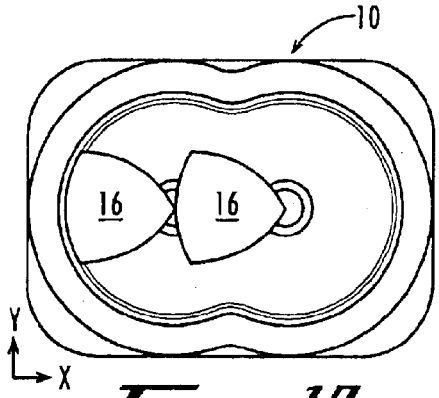
FIG. 19 is a front view of the rotary device of FIG. 8, showing the rotors at 330 degrees from the first position.
Figure 20:
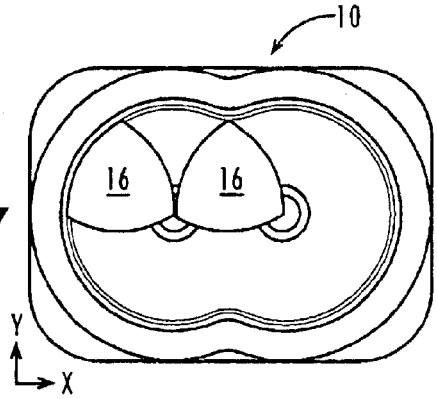
FIG. 20 is a front view of the rotary device of FIG. 8, showing the rotors at 360 degrees from the first position, i.e., back at the first position.

FIG. 15 shows the rotors 16 rotated to 210 degrees from the first position and FIG. 16 shows them rotated to 240 degrees from the first position to complete another 60-degree compression phase. FIG. 17 shows the rotors 16 rotated to 270 degrees from the first position and FIG. 18 shows them rotated to 300 degrees from the first position to complete another 60-degree intake or suction phase. FIG. 19 shows the rotors 16 rotated to 330 degrees from the first position and FIG. 20 shows them rotated to 360 degrees from the first position, i.e., back at the first position shown in FIG. 8, to complete another 60-degree neutral phase.

Referring now to FIGS. 21–31, the operation of the rotary machine 10 to compress fluid 38 will be described. This series of figures shows the rotors 16 compressing the fluid 38 before it is exhausted from the chamber 12. It will be understood that these figures are provided for illustrating the operation of the rotary machine when used in a compressor, just one of many different applications. In some other applications the operation of the rotary machine is different. For example, in pure pumping applications the fluid is expelled from the chamber under the force of the rotors without being compressed (or being only incidentally compressed).

Figure 21:
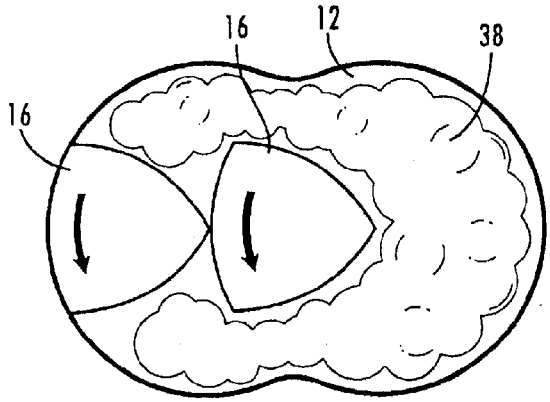
FIG. 21 is a front view of the rotary device of FIG. 1, showing the rotors in a first neutral phase of a series of rotor positions that illustrate the compressing and transporting of fluid through a complete rotary cycle.

In FIG. 21, the rotors 16 are rotating within the chamber 12 in a counterclockwise direction, and some fluid 38 is in the chamber. In this position, close rotor-to-rotor spacing and sealing is maintained, but the rotor-to-housing spacing and sealing is not. So the rotors 16 are in a first neutral phase that causes neither compression nor suction on the fluid 38.

Figure 22:
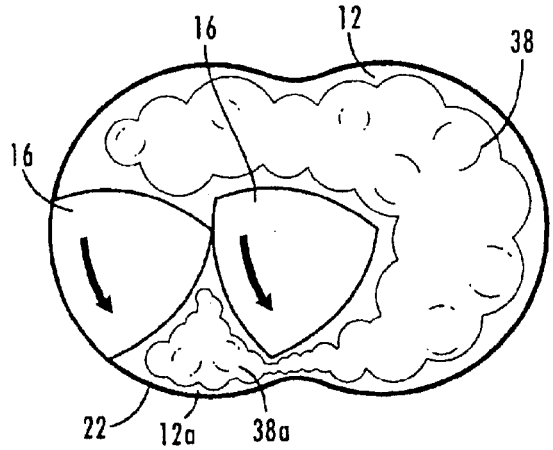
FIG. 22 is a front view of the rotary device of FIG. 21, showing the rotors just before the beginning of a first compression phase.
Figure 23:
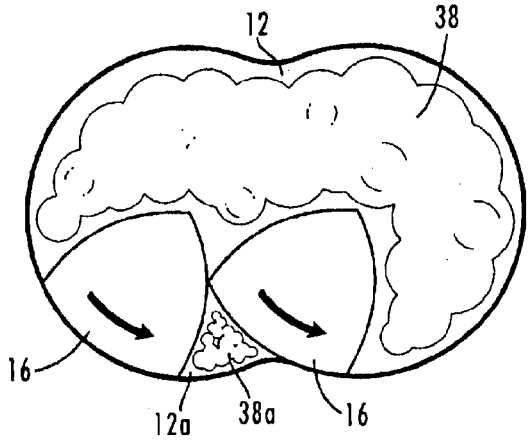
FIG. 23 is a front view of the rotary device of FIG. 21, showing the rotors during the first compression phase.
Figure 24:
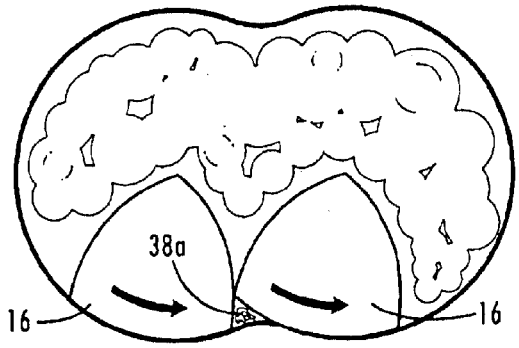
FIG. 24 is a front view of the rotary device of FIG. 21, showing the rotors just before the end of the first compression phase.

FIG. 22 shows the rotors 16 rotated into a position just before the beginning of a first compression phase, FIG. 23 shows the rotors during the first compression phase, and FIG. 24 shows the rotors just before the end of the first compression phase. During the first compression phase, good rotor-to-housing spacing is now maintained. So the rotors 16 and the chamber side walls 22 cooperate to form a first compression sub-chamber 12*a*. The first compression sub-chamber 12*a* decreases in size due to the rotation of the rotors 16 because the leading side of the left rotor is bearing down on the outer side of the right rotor. Accordingly, a first compression portion 38*a* of the fluid that is trapped within the first compression sub-chamber 12*a* is being compressed into a smaller and smaller space by the rotating rotors 16. At the same time, the rest of the chamber 12 is expanding and is therefore drawing in more of the fluid 38. At the end of the first compression phase, the fluid is released from the chamber 12 through the outlet by, for example, opening a valve.

Figure 25:
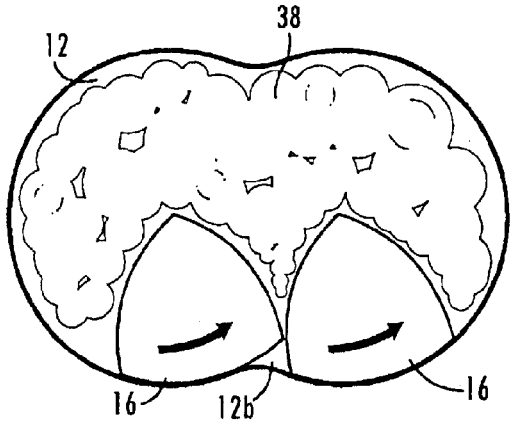
FIG. 25 is a front view of the rotary device of FIG. 21, showing the rotors just after the beginning of a first suction phase.
Figure 26:
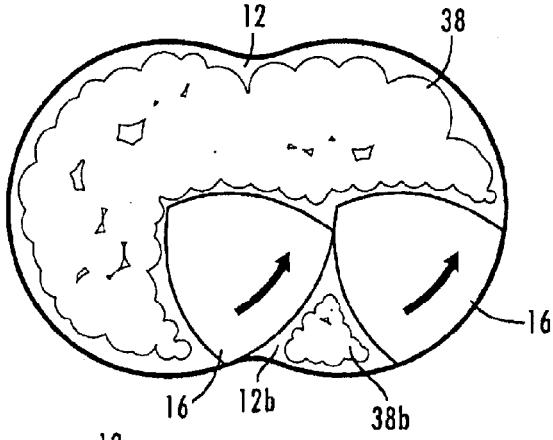
FIG. 26 is a front view of the rotary device of FIG. 21, showing the rotors during the first suction phase.

FIG. 25 shows the rotors 16 rotated into a position just after the beginning of a first suction phase, and FIG. 26 shows the rotors during the first suction phase. During the first suction phase, as the rotors 16 continue rotating, the trailing side of the right rotor pulls away from the outer side of the left rotor, thereby opening up a first suction sub-chamber 38*b*. As the first suction sub-chamber 38*b* expands, a first suction portion 12*b* of the fluid is drawn into it through the inlet port.

Figure 27:
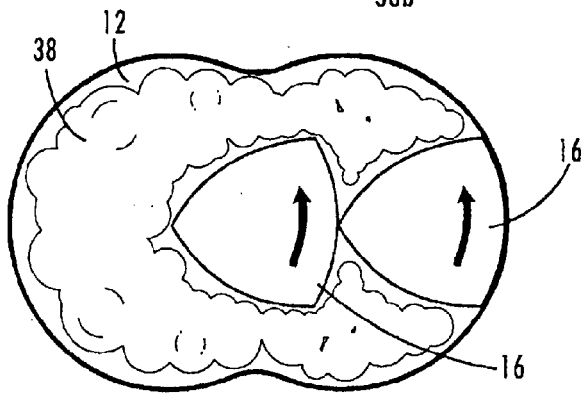
FIG. 27 is a front view of the rotary device of FIG. 1, showing the rotors in a second neutral phase.
Figure 28:
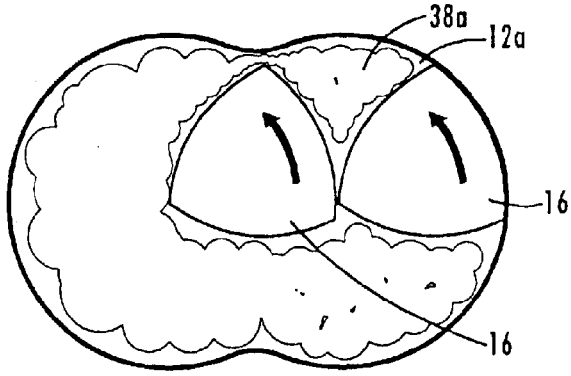
FIG. 28 is a front view of the rotary device of FIG. 21, showing the rotors just before the beginning of a second compression phase.
Figure 29:
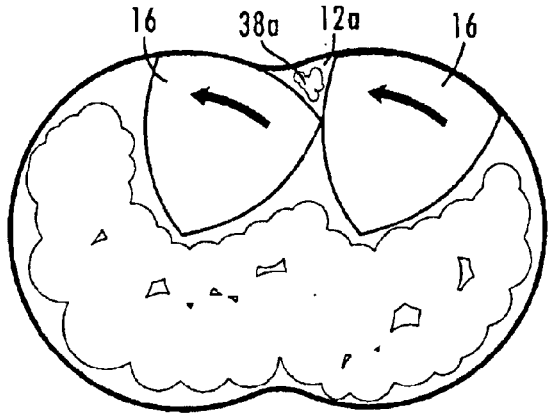
FIG. 29 is a front view of the rotary device of FIG. 21, showing the rotors during the second compression phase.
Figure 30:
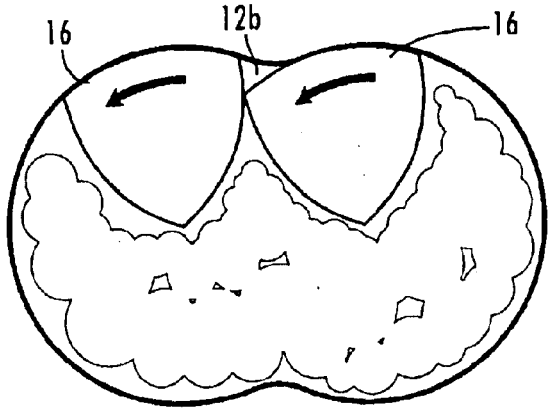
FIG. 30 is a front view of the rotary device of FIG. 21, showing the rotors just after the beginning of a second suction phase.
Figure 31:
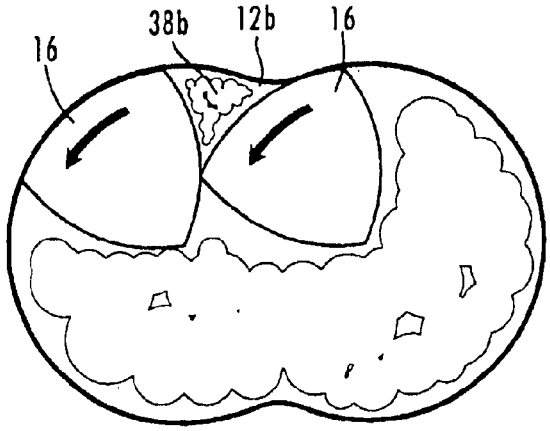
FIG. 31 is a front view of the rotary device of FIG. 21, showing the rotors during the second suction phase.
Figure 32:
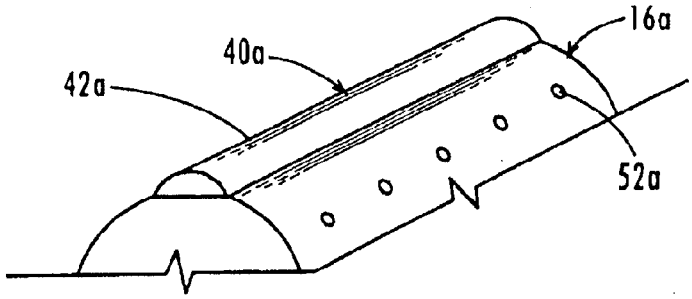
FIG. 32 is a perspective view of a portion of a rotor according to a first alternative embodiment, showing a fluid pressure-operated plunger seal in a retracted position on the rotor.

FIG. 27 shows a second neutral phase, during which the fluid 38 drawn into the chamber 12 during the first suction phase is redistributed within the chamber for compression during a subsequent compression phase. FIGS. 28 and 29 show a second compression phase similar to the first compression phase of FIGS. 22–24. And FIGS. 31 and 32 show a second suction phase similar to the first suction phase of FIGS. 25 and 26.

Accordingly, each complete 360-degree revolution of the rotors 16 in the chamber 12 produces two compression phases and two suction phases. In addition, because the rotors 16 rotate non-eccentrically, they can be configured to rotate at high speeds relative to other known eccentric rotary devices. This configuration produces very high efficiencies in fluid flow output relative to power input.

Figure 36:
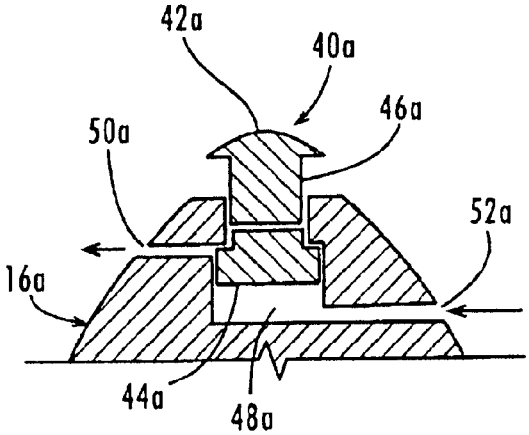
FIG. 36 is a cross sectional view of the rotor portion taken at line 36—36 of FIG. 35, showing fluid pressure holding the plunger seal in the extended position.

Referring now to FIGS. 32–36, there is shown a rotor 16*a* according to a first alternative embodiment. In this embodiment, the rotor 16*a* has a plunger seal 40*a* for rotor-to-rotor and rotor-to-housing sealing. The plunger seal 40*a* is operated by the differential in fluid pressure between the compression and suction sub-chambers the rest of the chamber (see also FIGS. 21–31 and the accompanying description). For example, the plunger seal 40*a* may have a plunger head 42*a*, a plunger foot 44*a*, and a plunger neck 46*a* between the head and foot. The plunger foot 44*a* is positioned in a retaining channel 48*a* that is formed in the rotor 16*a* and that is oversized for the foot. And the plunger neck 46*a* slidably extends through a connecting channel 49*a*. In this way, the plunger seal 40*a* can slide from a retracted position (FIG. 34) to an extended position (FIG. 36).

In order to automatically move the plunger seal 40*a* from the retracted position to the extended position, the rotor 16*a* has one or more outer apertures 50*a* and one or more inner apertures 52*a* formed in it. The outer apertures 50*a* are formed in the rotor 16*a* from a radially outer part of the retaining channel 48*a* through one side of the rotor. And the inner apertures 52*a* are formed in the rotor 16*a* from a radially inner part of the retaining channel 48*a* through another side of the rotor. The rotors 16*a* are configured so that when the inner apertures 52*a* are exposed to the higher pressure caused by the compression generated by the compression sub-chamber, and/or when the outer apertures 50*a* are exposed to the lower pressure caused by the suction generated by the suction sub-chamber, the plunger seal is automatically moved to and held in the extended position (see FIGS. 35 and 36). The faster the rotors 16*a* are turned, the greater the fluid pressure and the better the sealing effect.

Figure 33:
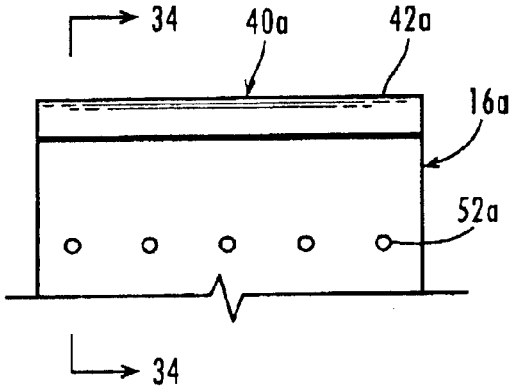
FIG. 33 is a side view of the rotor portion of FIG. 32.
Figure 34:
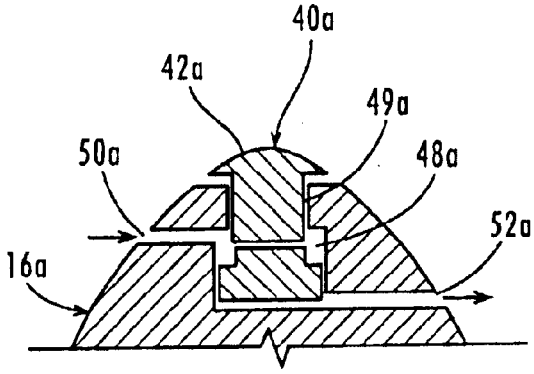
FIG. 34 is a cross sectional view of the rotor portion taken at line 34—34 of FIG. 33, showing fluid pressure holding the plunger seal in the retracted position.
Figure 35:
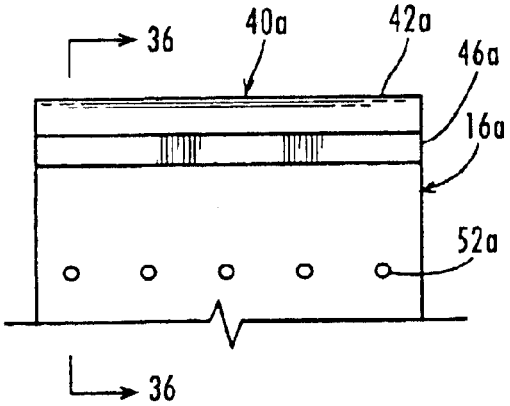
FIG. 35 is a side view of the rotor portion of FIG. 32, showing the plunger seal in an extended position.

Of course, opposite pressure differentials have the opposite effect, that is, when the inner apertures 52*a* are exposed to the lower pressure caused by the suction generated by the suction sub-chamber and/or when the outer apertures 50*a* are exposed to the higher pressure caused by the compression generated by the compression sub-chamber, the plunger seal is automatically moved to and held in the retracted position (see FIGS. 33 and 34). And in other embodiments, the rotors 16*a* are provided with only outer apertures, with only inner apertures, with inner apertures on the leading side of trailing rotor and with outer apertures on the trailing side of leading rotor, and in other configurations.

Figure 37:
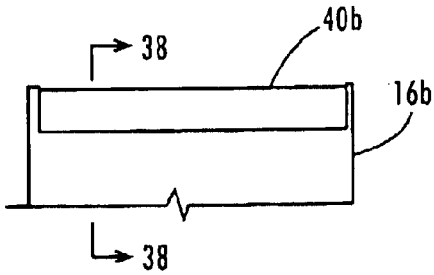
FIG. 37 is a side view of a portion of a rotor according to a second alternative embodiment, showing a spring-operated plunger seal in a retracted position on the rotor.
Figure 38:
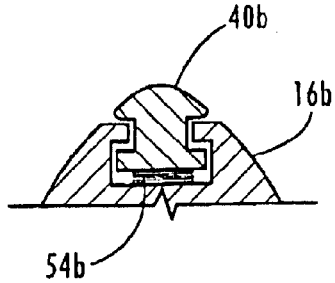
FIG. 38 is a cross sectional view of the rotor portion taken at line 38—38 of FIG. 37, showing the spring in a compressed state.
Figure 39:
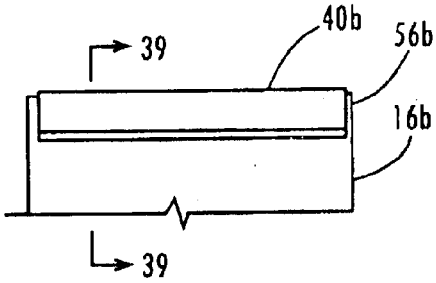
FIG. 39 is a side view of the rotor portion of FIG. 37, showing the plunger seal in an extended position.
Figure 40:
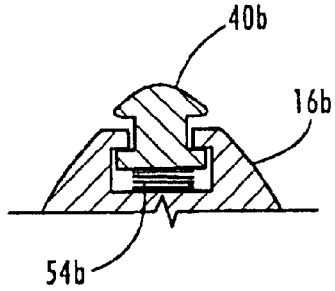
FIG. 40 is a cross sectional view of the rotor portion taken at line 40—40 of FIG. 37, showing the spring holding the plunger seal in the extended position.

Referring now to FIGS. 37–40, there is shown a rotor 16*b* according to a second alternative embodiment. In this embodiment, the rotor 16*b* has a plunger seal 40*b* for rotor-to-rotor and rotor-to-housing sealing. The plunger seal 40*b* is similar to that of the first alternative embodiment, except it is biased radially outwardly by a spring 54*b*. FIGS. 37 and 38 show the plunger seal 40*b* in a retracted position with the spring 54*b* in a compressed state, and FIGS. 39 and 40 show the plunger seal biased by the spring and held in an extended position. The spring 54*b* may be provided by a coil, leaf, or other type of spring selected to provide the outward force desired for the particular application. In addition, to eliminate the plunger seal 40*b* being constrained by friction with the housing side wall, the rotor 16*b* may have side tabs 56*b* between which the correspondingly shorter seal plunger extends.

Figure 41:
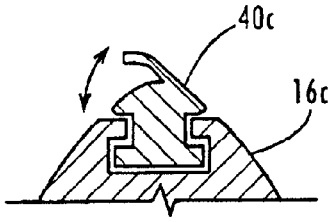
FIG. 41 is a side view of a portion of a rotor according to a third alternative embodiment, showing a flexible blade seal on the rotor.

Referring to FIG. 41, there is shown a rotor 16*c* according to a third alternative embodiment. In this embodiment, the rotor 16*c* has a flexible wiper blade-type seal 40*c* for rotor-to-rotor and rotor-to-housing sealing.

Figure 42:
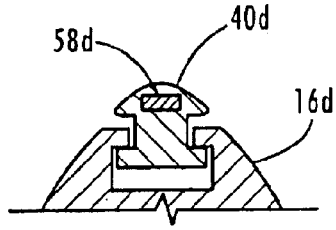
FIG. 42 is a front view of a rotor according to a fourth alternative embodiment, showing a centrifugal force-operated plunger seal in an extended position on the rotor.

Referring to FIG. 42, there is shown a rotor 16*d* according to a fourth alternative embodiment. In this embodiment, the rotor 16*d* has a plunger seal 40*d* for rotor-to-rotor and rotor-to-housing sealing. The plunger seal 40*d* is similar to that of the first alternative embodiment, except it is biased radially outwardly by centrifugal force from a weight 58*d* in the plunger. The weight 58*d* may be provided by one or more slabs, blocks, strips, rods, or other shapes of a dense (relative to the rest of the plunger seal) material such as a metal. In addition, the weight 58*d* may be embedded into the head of the plunger 40*d*, attached to or provided in place of the base of the plunger, or other otherwise incorporated in the plunger seal.

Figure 43:
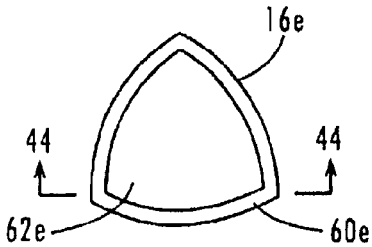
FIG. 43 is a front view of a rotor according to a fifth alternative embodiment, showing flange seals on the rotor for rotor-to-housing sealing.
Figure 44:
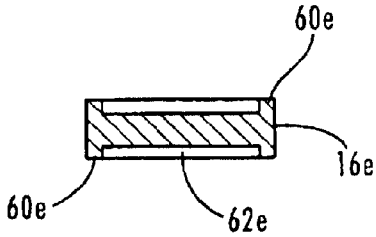
FIG. 44 is a cross sectional view of the rotor taken at line 44—44 of FIG. 43.

Referring to FIGS. 43 and 44, there is shown a rotor 16*e* according to a fifth alternative embodiment. In this embodiment, the rotor 16*e* has flange seals 60*e* for rotor-to-housing sealing. The flange seals 60*e* extend from the rotor 16*e* and may be attached to the rotor or integrally formed with the rotor as a single piece. This results in a recessed portion 62*e* of the rotor 16*e* that does not contact the housing side wall, so this configuration reduces the frictional drag on the rotors while still providing a good rotor-to-housing seal.

Figure 45:
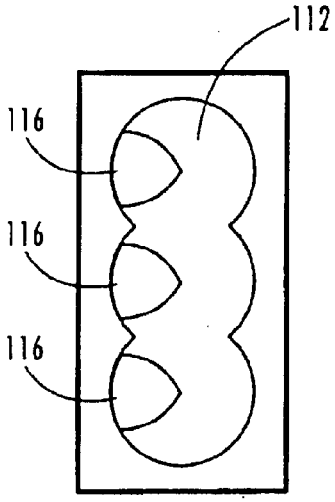
FIG. 45 is a front view of a rotary device according to a second exemplary embodiment of the present invention, showing three rotors mounted in a chamber.

Referring now to FIG. 45, in a second exemplary embodiment according to the present invention, the rotary machine 110 has an epitrochoidal chamber 112 with the shape of three partially overlapping circles and within which three rotors 116 rotate. In other embodiments, rotary machines have four or more rotors mounted in a chamber with the shape of four or more partially overlapping circles. It will be understood that any number of the rotors 116 can be provided, with a corresponding number of the overlapping circles forming the shape of the chamber 112. These configurations are well suited for applications where a narrow but long space is available for locating the rotary machine.

Figure 46:
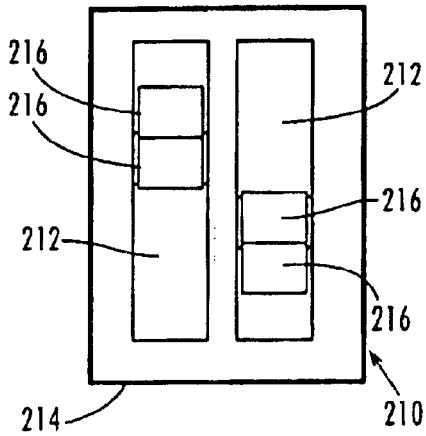
FIG. 46 is a side view of a rotary device according to a third exemplary embodiment, showing two sets of rotors mounted side-by-side in an offset configuration for balance.

Referring now to FIG. 46, in a third exemplary embodiment the rotary machine 210 has a housing 214 with two chambers 212 arranged back-to-back. The rotors 216 are offset by 180 degrees so that when one set of rotors are in the first neutral position of FIG. 21, the other set of rotors are in the second neutral position of FIG. 27. Both sets of the rotors 16 are operated synchronously, for example, by the same rotary linkage mechanism or by separate linkage mechanisms.

Figure 47:
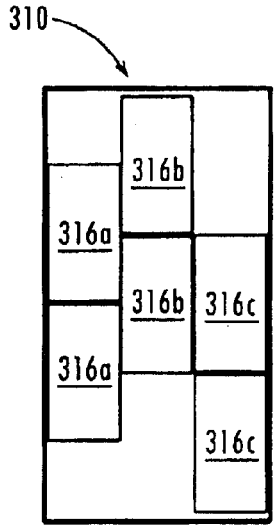
FIG. 47 is a side view of a portion of a rotary device according to a fourth exemplary embodiment, showing three sets of rotors, without the housing, arranged side-by-side in an offset configuration for balance.
Figure 48:
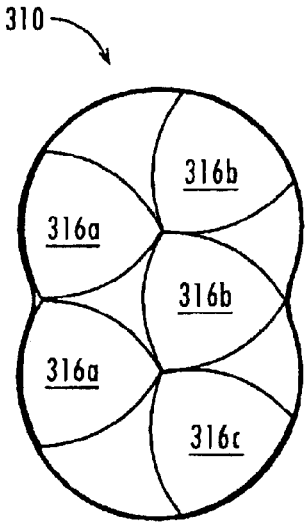
FIG. 48 is a front view of the rotary device of FIG. 47, showing the three sets of rotors.

Referring now to FIGS. 47 and 48, in a fourth exemplary embodiment the rotary machine 310 has three sets of rotors 316*a*, 316*b*, and 316*c* arranged back-to-back-to-back. The rotors 316*a*, 316*b*, and 316*c* are offset by 120 degrees, which provides smoother and more balanced operation. (In FIG. 48, one of the third rotors 316*c* is aligned with and therefore obscured by one of the second rotors 316*b*.) In other embodiments, rotary machines have four or more sets of rotors offset by 90-degrees or less. It will be understood that the rotary machine can be provided with any number of rotor sets, and that they can be combined into back-to-back, offset, and/or other arrangements as may be desired in a given application. In these configurations, the balance of the rotary machine during operation is so good that external flywheels, which are commonly used in conventional rotary and reciprocating engines, are not needed.

Figure 49:
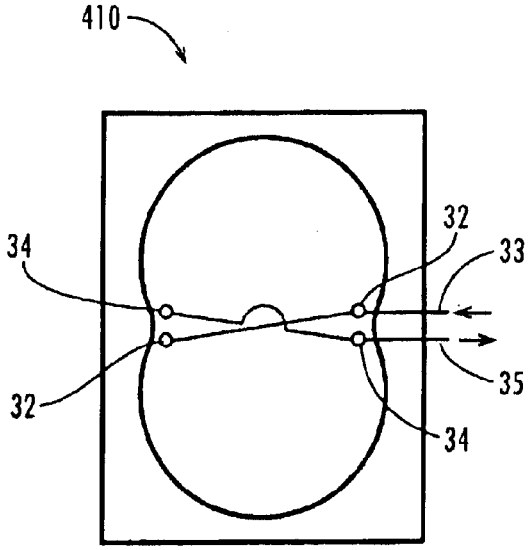
FIG. 49 is a front view of a rotary device according to a fifth exemplary embodiment of the present invention, showing two inlet ports connected together and two outlet ports connected together.

Referring now to FIG. 49, in a fifth exemplary embodiment the rotary machine 410 has the inlet ports 32 connected together by an inlet fluid line 33 and the outlet ports connected together by an outlet fluid line 35. The fluid lines 33 and 35 may be provided by flexible or rigid tubing or another structure selected for the operating temperatures and pressures of the particular application. It will be understood that where additional rotors or rotors sets are provided, the corresponding additional ports may also be connected together into a larger manifold.

In another alternative embodiment, the rotary machine has at least one rotor and corresponding circular chamber section that are larger in radius than another rotor and its corresponding circular chamber section. In this configuration, the rotary machine operates in both suction and compression, but produces only one suction phase and one compression phase per 360 degree cycle. This is because the smaller-radius rotor does not reach the center of the larger-radius chamber section. To minimize this effect, the larger-radius rotor may have a secondary rotor section on the opposite side of its axle from the main rotor section for reducing or eliminating the gap when the rotors are aligned in the neutral phase.

Having described several exemplary rotary machines of the present invention, there will now be described several compressing and/or pumping devices that incorporate these rotary machines. It will be understood that these are just several of the many applications for which these rotary machines are well suited, and that all viable applications are not described herein. In addition, any of the herein-described embodiments, as well as their equivalents, can be used in these and other compressing and/or pumping devices.

Figure 50:
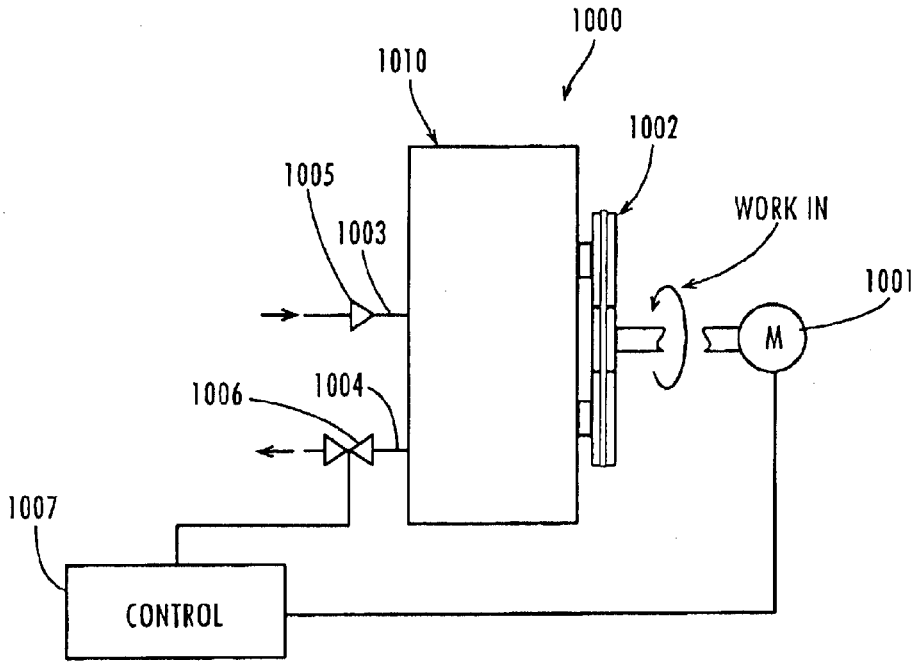
FIG. 50 is a block diagram of an exemplary air compressor including a rotary device according to the present invention.

FIG. 50 shows a compressor 1000 including a drive device 1001 operably coupled to a synchronous rotary linkage mechanism 1002 that is in turn operably coupled to a rotary machine 1010. The drive device 1001 is provided by an electric motor, a rotary actuator, a gasoline engine, a hand crank, or another powered or manual drive device. The rotary linkage mechanism 1002 is provided by a belt and pulleys, a chain and sprockets, or another conventional linkage assembly. The drive device 1001 delivers "work in" through the linkage mechanism 1002 to turn the rotors of the rotary machine 1010.

Connected to the rotary machine 1010 are fluid inlet and outlet lines 1003 and 1004. Although the suction and compression phases automatically draw in and expel the fluid, the fluid inlet and outlet lines 1004 may be provided with conventional valves 1005 and 1006 for further controlling the flow of the fluid into and out of the rotary machine chamber. For example, the inlet line 1003 may be provided with a conventional one-way check valve 2005 for permitting fluid flow in the desired direction and preventing undesired backflow of the fluid. And the outlet line 1004 may be provided with a conventional mechanical, spring, or electrically operated open/close valve 1006 for allowing the fluid to be compressed to the desired pressure before expelling it from the rotary machine chamber. The valve 1006 may be controlled by an automatic control system 1007, which may include microprocessor-based control components, wireless remote control components, mechanical linkages such as cams and connecting rods, and/or other conventional control components. Additionally or alternatively, the valve and 1006 may be controlled by manual operation.

The rotary machine 1010 and the other components of the compressor 1000 can be selected and configured for compressing air, a refrigerant, or most any another fluid, as may be desired for a particular application. Depending on the application, the inlet line 1003 may need to be connected to a reservoir or supply tank containing the fluid to be compressed. And the outlet line 1004 may need to be connected to some destination structure where the compressed fluid is stored or worked upon further.

Figure 51:
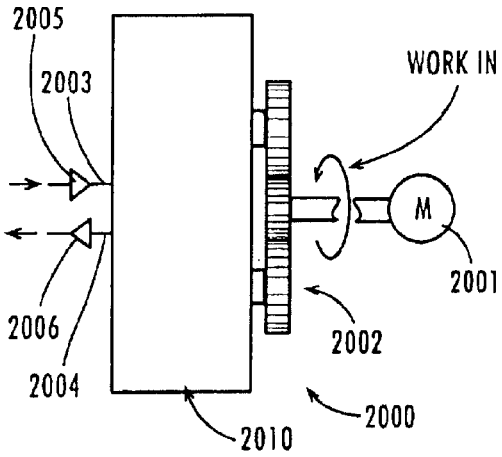
FIG. 51 is a block diagram of an exemplary positive pressure or vacuum pump including a rotary device according to the present invention.

FIG. 51 shows a pump 2000 including a drive device 2001 operably coupled to a synchronous rotary linkage mechanism 2002 that is in turn operably coupled to a rotary machine 2010. The drive device 2001 is provided by an electric motor, a rotary actuator, a gasoline engine, a hand crank, or another powered or manual drive device. The rotary linkage mechanism 2002 is provided by a gear train or another conventional linkage assembly. The drive device 2001 delivers "work in" through the linkage mechanism 2002 to turn the rotors of the rotary machine 2010.

Connected to the rotary machine 2010 are fluid inlet and outlet lines 2003 and 2004. For further controlling the flow of the fluid beyond that provided by the suction and compression phases, the inlet and outlet lines 2003 and 2004 may be provided with conventional valves 2005 and 2006. For example, the inlet and outlet lines 2003 and 2004 may be provided with one-way check valves 2005 and 2006 for permitting fluid flow in the desired direction and preventing undesired backflow of the fluid.

The rotary machine 2010 and the other components of the pump 2000 can be selected and configured for pumping air, water, an air/fuel mixture, a fuel, a lubricant, a refrigerant, hydraulic fluid, or most any another fluid, as may be desired for a particular application. In order to operate the pump 2000 as a positive pressure pump, the rotors of the rotary machine are turned in one direction. And in order to operate the pump 2000 as a vacuum pump, the rotors are turned in the opposite direction or the inlet and outlet line connections are switched.

Figure 52:
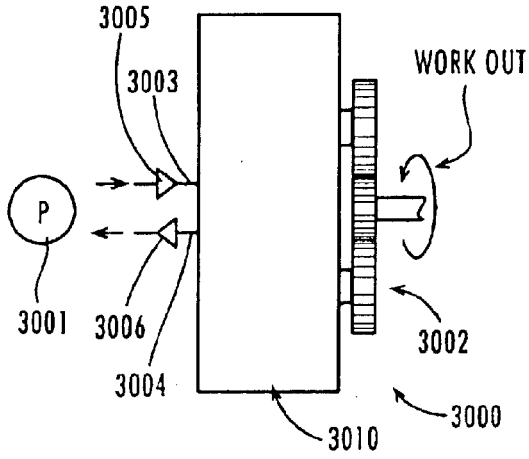
FIG. 52 is a block diagram of an exemplary rotary actuator including a rotary device according to the present invention.

FIG. 52 shows a rotary actuator 3000 including a synchronous rotary linkage mechanism 3002 that is operably coupled to a rotary machine 3010. The rotary linkage mechanism 3002 delivers "work out" from the turning rotors of the rotary machine 3010. This embodiment is well suited for applications where mechanical systems are preferred over electrical ones and/or where a high torque output is needed. For example, the actuator 3000 can be used in aviation for controlling of the flaps of an airplane.

Connected to the rotary machine 3010 are fluid inlet and outlet lines 3003 and 3004. For further controlling the flow of the fluid beyond that provided by the suction and compression phases, the inlet and outlet lines 3003 and 3004 may be provided with conventional valves 3005 and 3006. For example, the inlet and outlet lines 3003 and 3004 may be provided with one-way check valves 3005 and 3006 for permitting fluid flow in the desired direction and preventing undesired backflow of the fluid.

Operably coupled to the fluid inlet line 3003 is a drive device 3001 and a supply tank or reservoir of the working fluid. The rotary machine 3010 and the other components of the actuator 3000 can be selected and configured for operation using hydraulic fluid or another fluid as the working fluid. The drive device 3001 is provided by a pump, compressor, or another conventional device for transporting fluid. And the outlet line 3004 also can be connected to the supply tank or reservoir to form a closed loop.

In addition, in order to ensure that the fluid pumped into the rotary machine 3000 starts the rotors turning, the rotary machine may be configured so that at least one inlet port is unblocked by the rotors at any given startup position. For example, the inlet ports may be positioned asymmetrically and/or an increased number of rotors or rotors sets can be provided. Additionally or alternatively, the rotors may be provided with channels extending almost but not all the way across them, and configured in an arc aligned with the inlet ports, for receiving the inlet fluid and inducing rotor movement when the rotors block the inlet ports at startup.

Figure 53:
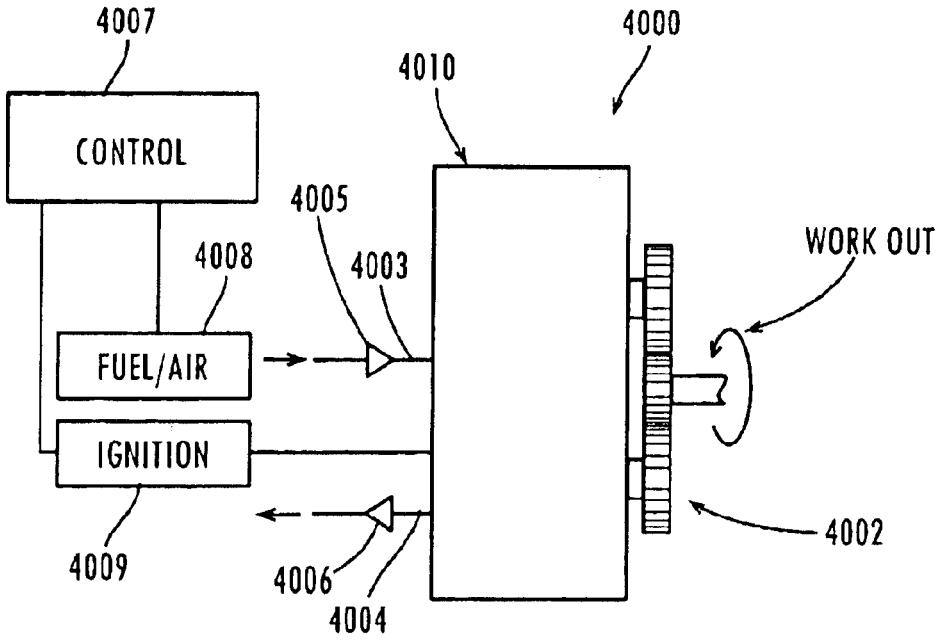
FIG. 53 is a block diagram of an exemplary internal combustion engine including a rotary device according to the present invention.
Figure 54:
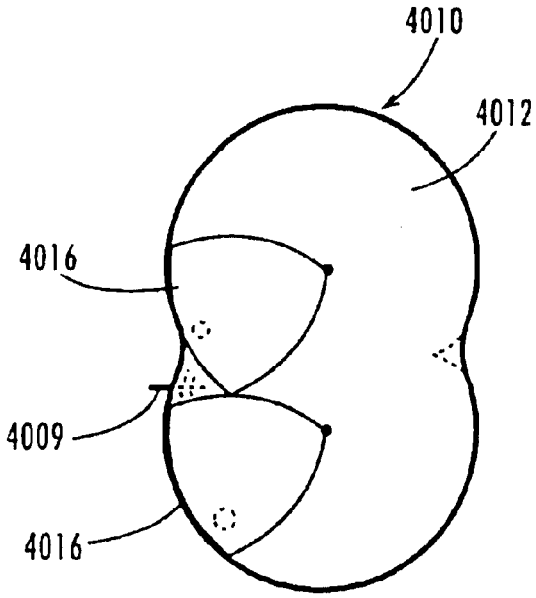
FIG. 54 is a front view of the internal combustion engine of FIG. 53, showing ignition of the fuel/air mixture.
Figure 55:
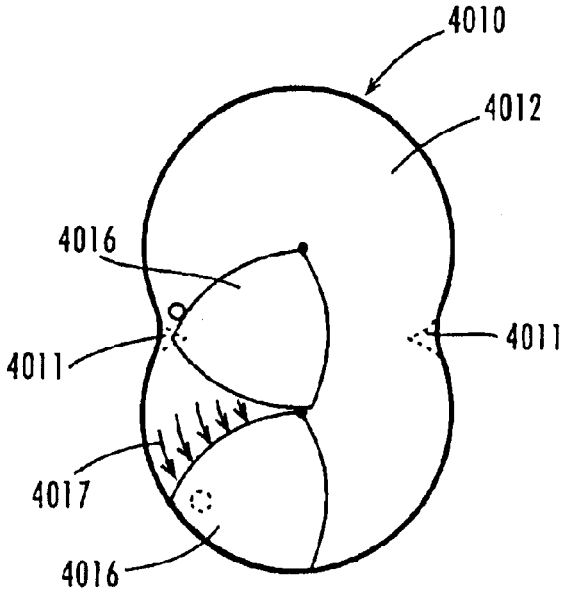
FIG. 55 is a front view of the internal combustion engine of FIG. 53, showing combustion forces moving the rotors in a power stroke.

FIGS. 53–55 show an internal combustion engine 4000 including a synchronous rotary linkage mechanism 4002 that is operably coupled to a rotary machine 4010. The rotary linkage mechanism 4002 delivers "work out" from the turning rotors of the rotary machine 4010. Because the rotary machine 4000 produces one suction stroke and one compression stroke in 180 degrees of rotation of the rotors, this embodiment is believed to represent an improvement over the conventional Wankel rotary engines well known in the art.

Connected to the rotary machine 4010 are fluid inlet and outlet lines 4003 and 4004. For further controlling the flow of the fluid beyond that provided by the suction and compression phases, the inlet and outlet lines 4003 and 4004 may be provided with conventional valves 4005 and 4006. For example, the inlet and outlet lines 4003 and 4004 may be provided with one-way check valves 4005 and 4006 for permitting fluid flow in the desired direction and preventing undesired backflow of the fluid.

The unique configuration of the inlet and outlet ports and the rotors allows the rotary machine 4000 to operate in suction and compression without the need for complicated timing cams, rods, and spring valves, as are typically employed in internal combustion engines. In this unique configuration, the rotors themselves act as valves, automatically opening and closing the inlet and outlet ports at the right time for the suction and compression strokes. In addition, because of the balanced rotor configuration, the traditional flywheel of internal combustion engines is not needed.

Operably coupled to the fluid inlet line 4003 is a fuel/air supply system 4008 and an ignition system 4009, which are operably connected to a control system 4007. The fuel/air supply system 4008 includes a fuel tank and an optional fuel pump, though the pump may not be needed because of the suction generated by the rotors. And the ignition system 4009 includes a spark plug or another ignitor. In addition, conventional lubricating and cooling systems are provided, although these are not shown in the figures. The fuel and air can be premixed before they are drawn into the chamber 4012 of the rotary machine 4010 or they can be mixed in the chamber. Because the fluid is being burned to produce work, the outlet port carries away the combustion byproducts, i.e., it functions as an exhaust.

Referring in particular to FIGS. 54 and 55, details of the combustion process will be described. After the rotors 4016 have rotated in the chamber 4012 to compress the fuel/air mixture (see also FIG. 24), the compression sub-chamber has collapsed and the fuel/air mixture is transferred to the now-expanding suction sub-chamber. For example, the fuel/air mixture may transfer by flowing though a gap 411 between the suction and the compression sub-chambers, by flowing through an external fluid line connected between the suction and the compression sub-chambers, or in another way. Then the ignition system 4009 is operated to light the fuel/air mixture. As the highly compressed fuel/air mixture burns, it expands very rapidly. The rapidly expanding combustion gas exerts a great force on the trailing side of the leading rotor 4016 and on the outer side of the trailing rotor 4016. The combustion forces on the outer side of the trailing rotor 4016 are directed generally radially toward the rotation point, so these forces do not significantly effect the movement of the trailing rotor. But the combustion forces 4017 on the trailing side of the leading rotor 4016 are in generally the same direction that the rotor is moving, so these forces urge this rotor to rotate even faster. The rotors 4016 thereby deliver a rotary motion to an output shaft of the linkage mechanism 4002. The linkage mechanism 4002 in turn is operably connected to a clutch or another selective engagement mechanism, if so desired. Because of the high efficiencies produced, a small engine can be used to propel a vehicle, run machinery, generate electricity, and so forth.

In view of the foregoing, it will be appreciated that the present invention provides an innovative rotary machine that is operable to generate a rotary motion to pump and/or compress fluid. Advantageously, the rotary machine may be configured to provide two compression strokes and two intake strokes for each 360-degree revolution of the rotors, which contributes to a very high mechanical efficiency. In addition, the rotary machine has rotors that rotate non-eccentrically for smoother operation. Furthermore, the unique configuration of the inlet and outlet ports and the rotors allows the rotary machine to be used without the need for complicated timing cams, rods, and valves.

It is to be understood that this invention is not limited to the specific devices, methods, conditions, and/or parameters described and/or shown herein, and that the terminology used herein is for the purpose of describing particular embodiments by way of example only. Thus, the terminology is intended to be broadly construed and is not intended to be limiting of the claimed invention. In addition, as used in the specification including the appended claims, the singular forms "a," "an," and "the" include the plural, plural forms include the singular, and reference to a particular numerical value includes at least that particular value, unless the context clearly dictates otherwise. Furthermore, any methods described herein are not intended to be limited to the sequence of steps described but can be carried out in other sequences, unless expressly stated otherwise herein.

Moreover, while certain embodiments are described above with particularity, these should not be construed as limitations on the scope of the invention. It should be understood, therefore, that the foregoing relates only to exemplary embodiments of the present invention, and that numerous changes may be made therein without departing from the spirit and scope of the invention as defined by the following claims.

The invention claimed is:

1. A rotary device, comprising:

a housing defining at least one chamber having an epitrochoidal shape defined by two or more partially overlapping circles, wherein each one of the partially overlapping circles intersects a center of an adjacent one of the circles, one or more inlet ports in fluid communication with the chamber, and one or more outlet ports in fluid communication with the chamber;

two or more rotors that cooperate to temporarily define one or more compression sub-chambers and one or more suction sub-chambers as the rotors rotate synchronously within the chamber; and a linkage for synchronously rotating the rotors, wherein each one of the rotors has a curved outer side having the same radius, each one of the rotors rotates about a corresponding axis, and the distance between the axes is substantially the same as the radius of the outer sides of the rotors, which in turn is substantially the same as the radius of the circles defining the chamber.

2. A rotary device, comprising:

a housing defining at least one chamber having an epitrochoidal shape defined by two or more partially overlapping circles with each one of the partially overlapping circles having the same radius, one or more inlet ports in fluid communication with the chamber, and one or more outlet ports in fluid communication with the chamber;

two or more rotors that cooperate to temporarily define one or more compression sub-chambers and one or more suction sub-chambers as the rotors rotate synchronously within the chamber; and a linkage for synchronously rotating the rotors, wherein at least one of the outlet ports is positioned in a compression corner of a non-overlapping part of one of the circles defining the chamber, the corner defined by a side wall of the housing, an arc of an overlapping part of an adjacent one of the circles, and a leading side of a trailing one of the rotors as the leading side defines one of the compression sub-chambers.

3. A rotary device, comprising:

a housing defining at least one chamber having a shape defined by two or more partially overlapping circles, two or more inlet ports in fluid communication with the chamber, and two or more outlet ports in fluid communication with the chamber, wherein the inlet ports are connected together in fluid communication and the outlet ports are connected together in fluid communication;

two or more rotors that cooperate to temporarily define one or more compression sub-chambers and one or more suction sub-chambers as the rotors rotate synchronously within the chamber; and a linkage for synchronously rotating the rotors, wherein at least one of the outlet ports is positioned in a compression corner of a non-overlapping part of one of the circles defining the chamber, the corner defined by a side wall of the housing, an arc of an overlapping part of an adjacent one of the circles, and a leading side of a trailing one of the rotors as the leading side defines one of the compression sub-chambers.

4. A rotary device, comprising:

a housing defining at least one chamber having an epitrochoidal shape defined by two or more partially overlapping circles, wherein each one of the partially overlapping circles intersects a center of an adjacent one of the circles, one or more inlet ports in fluid communication with the chamber, and one or more outlet ports in fluid communication with the chamber;

two or more rotors that cooperate to temporarily define one or more compression sub-chambers and one or more suction sub-chambers as the rotors rotate synchronously within the chamber; and a linkage for synchronously rotating the rotors, wherein at least one of the outlet ports is positioned in a compression corner of a non-overlapping part of one of the circles defining the chamber, the corner defined by a side wall of the housing, an arc of an overlapping part of an adjacent one of the circles, and a leading side of a trailing one of the rotors as the leading side defines one of the compression sub-chambers.

5. The rotary device of claim 4, wherein the rotors rotate non-eccentrically in the chamber.

6. The rotary device of claim 5, wherein the rotors are trochoidal-shaped.

7. The rotary device of claim 5, wherein the rotors have curved sides with the same radius as the circles defining the chamber.

8. The rotary device of claim 4, wherein the rotors continuously contact or remain in close proximity with each other to provide rotor-to-rotor sealing throughout a 360 degree rotary cycle.

9. The rotary device of claim 4, wherein the rotors remain in close proximity with a side wall of the housing to provide rotor-to-housing sealing when the rotors turn through non-overlapping parts of the circles defining the chamber.

10. The rotary device of claim 4, wherein the compression sub-chamber is formed by an outer side of a leading one of the rotors, a leading side of a trailing one of the rotors, and a chamber side wall.

11. The rotary device of claim 4, wherein the suction sub-chamber is formed by a trailing side of a leading one of the rotors, an outer side of a trailing one of the rotors, and a chamber side wall.

12. The rotary device of claim 4, wherein the compression sub-chamber and the suction sub-chamber are not formed by the rotors when the rotors turn through non-overlapping parts of the circles defining the chamber.

13. The rotary device of claim 4, wherein the inlet ports and the outlet ports are positioned in the chamber so that as the rotors turn, the rotors alternatingly cover and then uncover the inlet ports and the outlet ports.

14. The rotary device of claim 4, wherein, as the rotors turn to collapse the compression sub-chamber, another part of the chamber is expanding, and at least one of the inlet ports is are positioned in the other part of the chamber.

15. The rotary device of claim 4, wherein the rotary machine comprises three or more rotors and the chamber has the shape of three or more partially overlapping circles.

16. The rotary device of claim 4, wherein the rotary machine comprises two or more sets of the rotors arranged side-by-side and offset from each other for balance.

17. The rotary device of claim 4, wherein each of the rotors has at least one seal.

18. The rotary device of claim 17, wherein the seal comprises at least one fluid pressure-operated plunger seal.

19. The rotary device of claim 17, wherein the seal comprises at least one spring-operated plunger seal.

20. The rotary device of claim 17, wherein the seal comprises at least one flexible blade seal.

21. The rotary device of claim 17, wherein the seal comprises at least one centrifugal force-operated plunger seal.

22. The rotary device of claim 17, wherein the seal comprises at least one flange seal for rotor-to-housing sealing.

23. A compressor including one or more of the rotary devices of claim 4, a rotary linkage mechanism operably coupled to the rotors of the rotary device, a drive device operably coupled to the linkage mechanism, a valve operably coupled to the outlet port, and a control system for operating the valve.

24. A pump including one or more of the rotary devices of claim 4, a rotary linkage mechanism operably coupled to the rotors of the rotary device, and a drive device operably coupled to the linkage mechanism.

25. A rotary actuator including one or more of the rotary devices of claim 4, a rotary linkage mechanism operably coupled to the rotors of the rotary device, and a drive device operably coupled to the fluid inlet ports.

26. An internal combustion engine including one or more of the rotary devices of claim 4, a rotary linkage mechanism operably coupled to the rotors of the rotary device, an ignition system, and a control system for operating the ignition system.

27. A rotary device, comprising:

a housing defining at least one chamber having a shape defined by two or more partially overlapping circles, one or more inlet ports in fluid communication with the chamber, and one or more outlet ports in fluid communication with the chamber;

two or more rotors that cooperate to temporarily define one or more compression sub-chambers and one or more suction sub-chambers as the rotors rotate synchronously within the chamber; and a linkage for synchronously rotating the rotors, wherein each of the rotors has at least one seal comprising a plunger that moves between a retracted position and an extended position relative to the corresponding rotor, the plunger having a head for sealing and a foot, wherein the rotor has a retaining channel defined therein that receives and is oversized relative to the foot, one or more outer apertures defined therein from a radially outer part of the retaining channel through a side of the rotor, and one or more inner apertures defined therein from a radially inner part of the retaining channel through another side of the rotor, wherein the plunger seal is moved to and held in the extended position in response to a greater pressure at the inner apertures than the outer apertures.

28. A rotary device, comprising:

a housing defining at least one chamber having a shape defined by two or more partially overlapping circles, one or more inlet ports in fluid communication with the chamber, and one or more outlet ports in fluid communication with the chamber;

two or more rotors that cooperate to temporarily define one or more compression sub-chambers and one or more suction sub-chambers as the rotors rotate synchronously within the chamber; and a linkage for synchronously rotating the rotors, wherein at least one of the outlet ports is positioned in a compression corner of a non-overlapping part of one of the circles defining the chamber, the corner defined by a side wall of the housing, an arc of an overlapping part of an adjacent one of the circles, and a leading side of a trailing one of the rotors as the leading side defines one of the compression sub-chambers, and wherein at least one of the inlet ports is positioned in a suction corner of a non-overlapping part of one of the circles defining the chamber, the corner defined by a side wall of the housing, an arc of an overlapping part of an adjacent one of the circles, and a trailing side of a leading one of the rotors as the trailing side defines one of the suction sub-chambers.

29. The rotary device of claim 28, wherein the one or more inlet ports comprise two inlet ports, the one or more outlet ports comprise two outlet ports, the inlet ports are arranged cater-cornered from each other, and the outlet ports are arranged cater-cornered from each other.

30. The rotary device of claim 28, wherein chamber has a semi-hourglass shape, and the inlet ports and the outlet ports are positioned just to one side or another of a narrowest part of the semi-hourglass shaped chamber.

31. The rotary device of claim 28, wherein the housing has a front wall, a rear wall, and a side wall that define the chamber, the inlet ports and the outlet ports are defined in the front wall, the rear wall, or both, and the side wall is continuous and free of ports.

32. A rotary device, comprising:

a housing having a side wall defining at least one chamber with an epitrochoidal shape defined by two partially overlapping circles, wherein each one of the circles intersects a center of an adjacent one of the circles and both of the circles have the same radius;

one or more inlet ports and one or more outlet ports defined in the housing in fluid communication with the chamber;

two non-eccentric rotors each having a trochoidal shape with curved outer, leading, and trailing sides all having the same radius as the circles defining the chamber, the rotors cooperating to temporarily define two compression sub-chambers and two suction sub-chambers as the rotors rotate synchronously within the chamber through a 360-degree rotary cycle, wherein the compression sub-chambers are formed by the outer side of a leading one of the rotors, the leading side of a trailing one of the rotors, and the chamber side wall, wherein the suction sub-chambers are formed by the trailing side of a leading one of the rotors, the outer side of a trailing one of the rotors, and the chamber side wall, wherein the compression sub-chambers and the suction sub-chambers are not formed by the rotors when the rotors turn through non-overlapping parts of the circles in two neutral phases, and wherein each one of the rotors rotates about a corresponding axis, and the distance between the axes is substantially the same as the radius of the outer sides of the rotors, which in turn is substantially the same as the radius of the circles defining the chamber; and a linkage for synchronously rotating the rotors.

33. The rotary device of claim 32, wherein the axes are defined at an intersection of the leading side and the trailing side of each rotor.

34. The rotary device of claim 32, wherein the rotors have three curved sides each having the same radius.

* * * * *

UNITED STATES PATENT AND TRADEMARK OFFICE

CERTIFICATE OF CORRECTION

PATENT NO. : 6,886,528 B2
DATED : May 3, 2005
INVENTOR(S) : Richard G. James

It is certified that error appears in the above-identified patent and that said Letters Patent is hereby corrected as shown below:

Column 6,
Line 60, delete "321" and insert therefor -- 32 --.

Signed and Sealed this

Nineteenth Day of July, 2005

JON W. DUDAS
*Director of the United States Patent and Trademark Office*